US005223650A

United States Patent [19]

Finn

[11] Patent Number: 5,223,650

[45] Date of Patent: Jun. 29, 1993

[54] TELESCOPIC SIGHT WITH LEVEL INDICATOR

[76] Inventor: Charles A. Finn, 2955 Cottingham St., Oceanside, Calif. 92054

[21] Appl. No.: 906,044

[22] Filed: Jun. 26, 1992

Related U.S. Application Data

[63] Continuation of Ser. No. 774,716, Oct. 9, 1991, abandoned.

[51] Int. Cl.[5] ..... F41G 1/38; F41G 1/44

[52] U.S. Cl. ..... 42/101; 42/97; 33/246

[58] Field of Search ..... 42/101, 100, 103, 1.01, 42/97; 33/241, 240, 245, 246

[56] References Cited

U.S. PATENT DOCUMENTS

| | | | |
|---|---|---|---|
| 2,243,793 | 5/1941 | Cummins | 33/245 |
| 2,308,635 | 1/1943 | Walker | 33/241 |
| 3,166,848 | 1/1965 | Petzsch | 42/100 |
| 3,556,666 | 1/1971 | Lichtenstern | 33/241 |
| 3,824,699 | 7/1974 | Lenz et al. | 33/334 |
| 3,997,974 | 12/1976 | Larson | 33/265 |
| 4,325,190 | 4/1982 | Duerst | 33/241 |
| 4,375,135 | 3/1983 | Wigger | 42/1.01 |
| 4,476,644 | 10/1984 | Laing | 42/1.01 |
| 4,535,544 | 8/1985 | Jones et al. | 33/241 |
| 4,561,204 | 12/1985 | Binion | 33/245 |
| 5,005,308 | 4/1991 | Parks | 42/101 |

FOREIGN PATENT DOCUMENTS

| | | | |
|---|---|---|---|
| 962585 | 4/1957 | Fed. Rep. of Germany | 33/246 |
| 301225 | 9/1932 | Italy | 42/1.01 |
| 144367 | 3/1954 | Sweden | 42/100 |

OTHER PUBLICATIONS

Brown, Popular Mechanics {Build Your Own Riflescopes}, Jan., 1949 pp. 198-203.

*Primary Examiner*—Stephen M. Johnson
*Attorney, Agent, or Firm*—Wagner & Middlebrook

[57] ABSTRACT

A tilt or cant indicator for telescopic sights incorporates a gravity responsive device aligned with the reticle or vertical crosshair of the sight. A pendulum device incorporating a pointer is installed with its rotational axis intersecting the vertical crosshair such that canting is indicated when the vertical crosshair is not the pointer.

4 Claims, 4 Drawing Sheets

FIG. 1
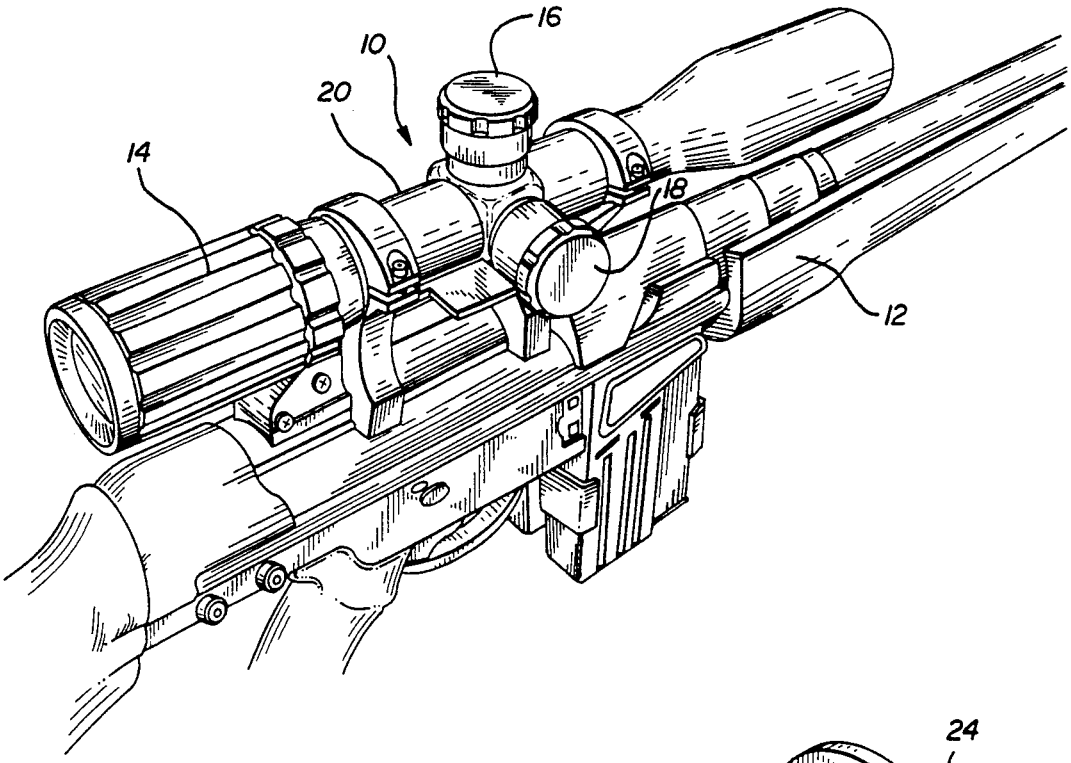
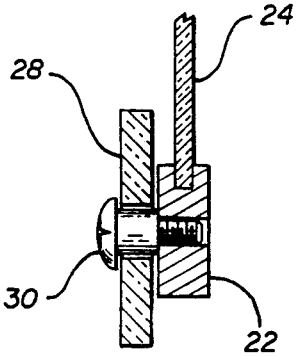
FIG. 3
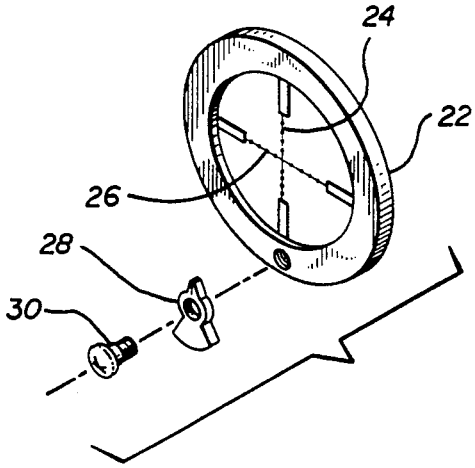
FIG. 2

FIG. 4
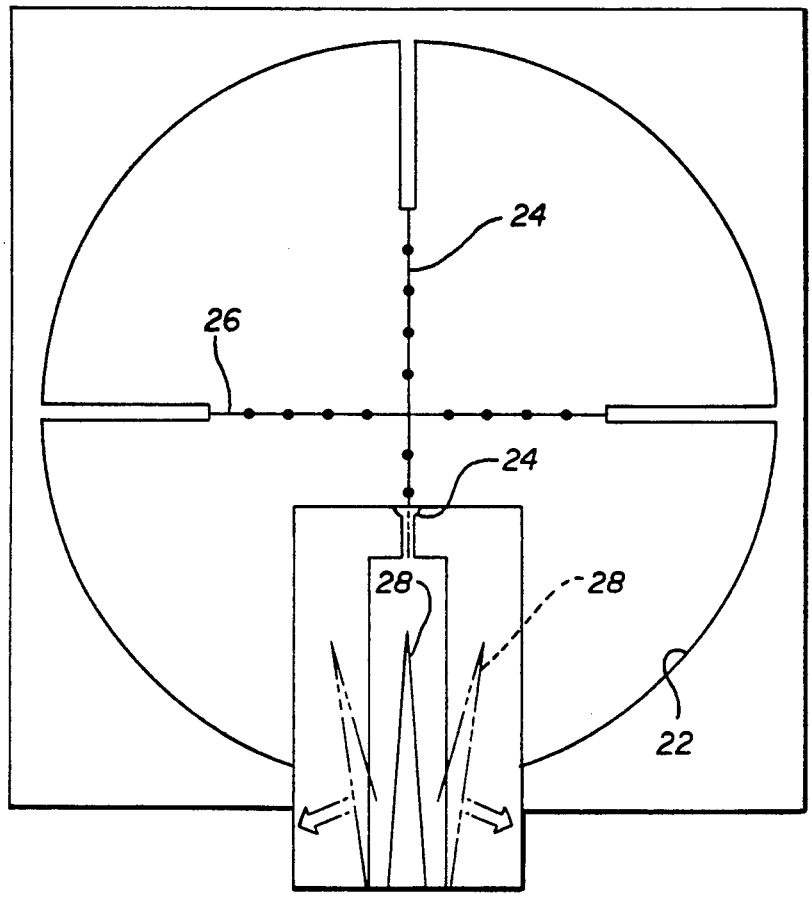
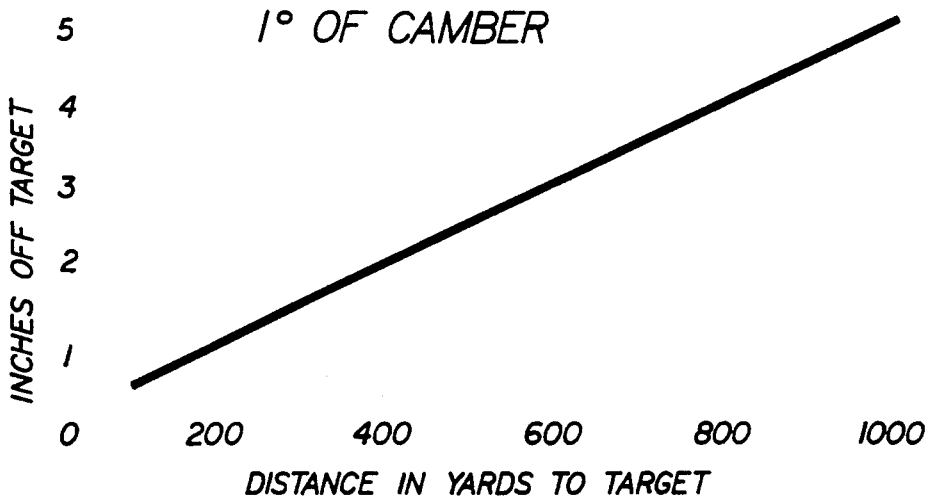
FIG. 5

TELESCOPIC SIGHT WITH LEVEL INDICATOR

This is a continuation of copending application Ser. No. 07/774,716 filed on Oct. 9, 1991 now abandoned.

BACKGROUND OF THE INVENTION

This invention relates to telescopic sights for firearms and more particularly to a sight incorporating means for detecting and signalling the operator when the firearm is canted from the vertical.

Telescopic sights have been used for many decades as a means for insuring accurate shooting of rifles at substantial distances. Such sights frequently include means for making windage and elevation adjustments so that very good accuracy can be achieved even at distances of 1000 to 2000 yards. It has been observed, however, that even with a very accurate job of "zeroing in" the rifle, misses can still happen which are attributable to a failure to hold the rifle in position in which the telescopic sight is directly above the bore of the rifle. Tests have shown that even a very small amount of tilt or cant can throw the rifle off enough to cause a missed shot, particularly where the target is at a substantial distance.

BRIEF DESCRIPTION OF THE INVENTION

In recognizing the above problem area, applicant has devised gravity responsive structures which are either built into a telescopic sight or which may be incorporated into the sight after its manufacture. One such structure constitutes a gravity pendulum device having a pointer which is incorporated into the sight such that its pivot and attachment means is aligned with the reticle, which may be the vertical crosshair. Should the crosshairs be right on the target, but the rifle or other firearm be tilted or canted from the vertical, this fact will be clear to the shooter because the pointer will not be aligned with the vertical crosshair.

By canted, applicant means that the telescopic sight is not directly above the bore of the rifle, which is indicated by the above described gravity responsive devices.

BRIEF DESCRIPTION OF THE DRAWINGS

This invention may be more clearly understood from the following detailed description and by reference to the drawings in which:

FIG. 1 is a perspective drawing showing a telescopic sight installed on a typical rifle;

FIG. 2 is an exploded view of one embodiment of gravity responsive device installed in a telescopic sight;

FIG. 3 is a fragmentary sectional view of the device of FIG. 2, as assembled;

FIG. 4 is a diagram showing a typical sighting pattern seen through a telescopic sight with the indicator of FIGS. 2 and 3 installed;

FIG. 5 is a graph indicating, for various ranges, the amount of error at the target attributable to a canting error of 1 degree.

DETAILED DESCRIPTION OF THE INVENTION

Figure 6:
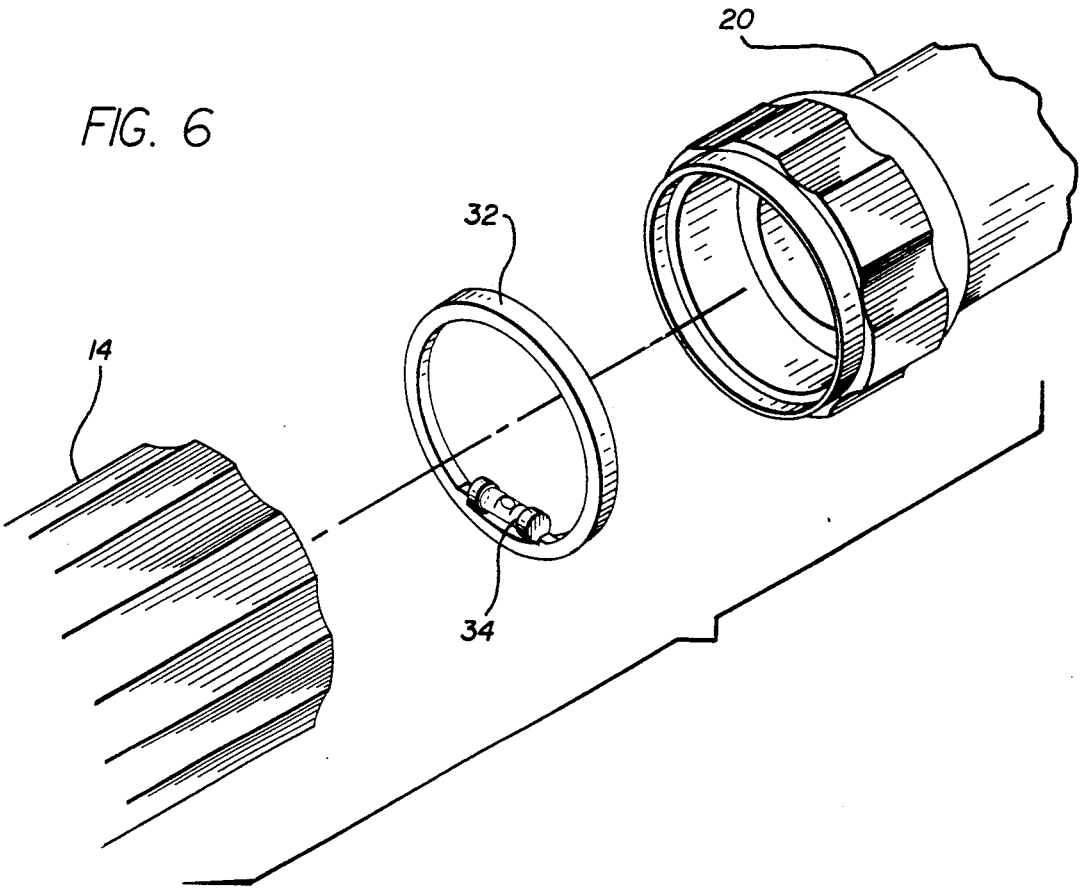
Figure 7:
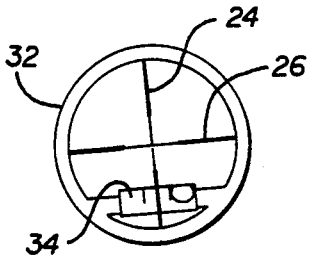
Figure 8:
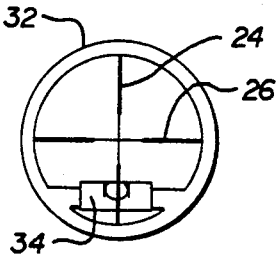
Figure 9:
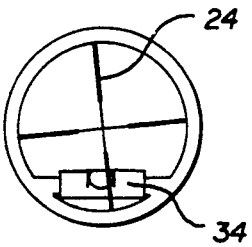
Figure 10:
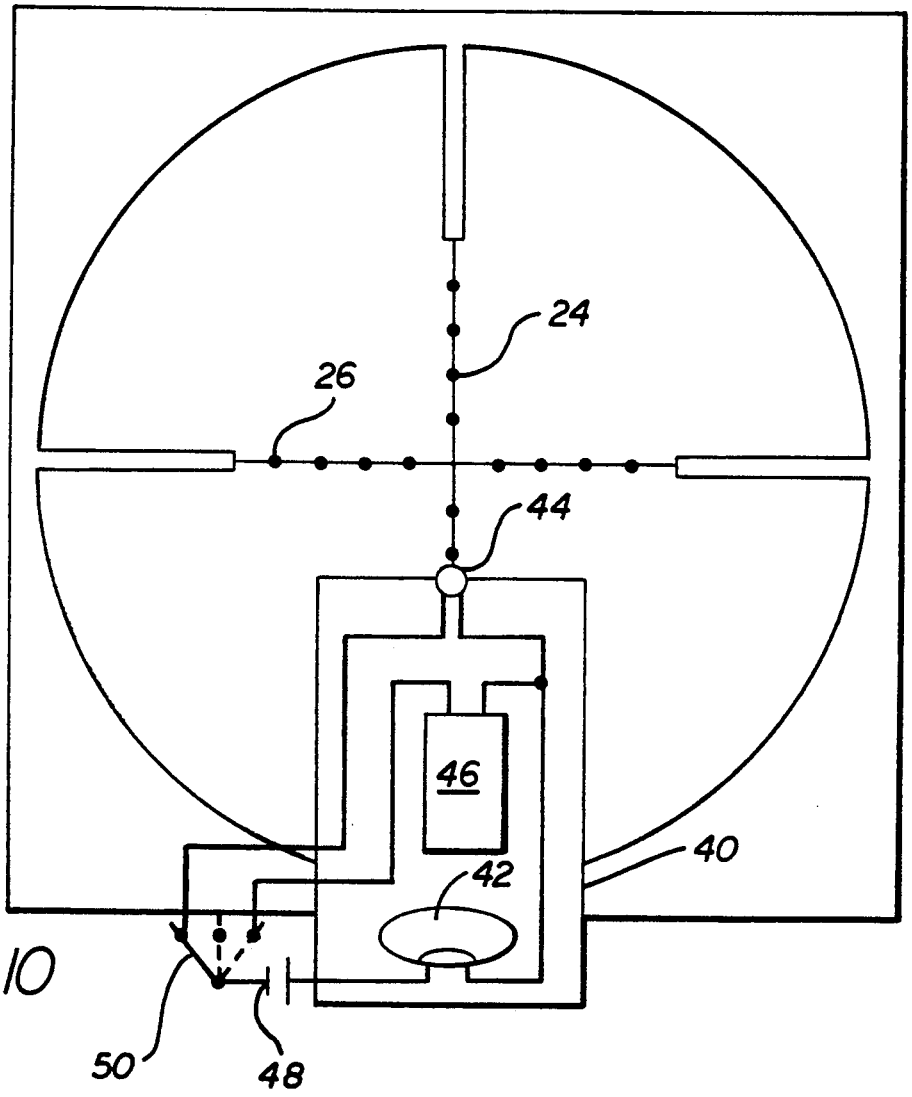

Referring now to FIG. 1, a typical telescopic sight 10 is shown mounted on a rifle 12. The sight includes a plurality of lenses, only the lens in the eyepiece lens cover 14 being shown. Also forming part of the telescopic sight 10 are target knobs 16 and 18 for making elevation and windage adjustments, respectively.

Located within the barrel 20 of telescopic sight 10 near windage and elevation adjustments 18 and 16 is a ring 22 containing a reticle including, in this embodiment, a vertical crosshair 24 and a horizontal crosshair 26, as shown in FIG. 2. In exploded relationship to ring 22 are shown a pendulum member 28 which is fastened to ring 22 by means of a screw 30. The structure, as assembled, appears in the sectional view, FIG. 3, wherein pendulum member 28 is shown fastened to ring 22 by means of screw 30. The threads of screw 30 and the mating threads in ring 22 are preferably very fine, allowing adjustment of the response of pendulum 28 by slight variations in turning of screw 30.

FIG. 4 is a diagram showing a sighting pattern such as might be seen looking through telescopic sight 10 with the pendulum member 28 shown enlarged and centered in one position and in phantom in alternate non-centered positions. Vertical crosshair 24 and horizontal crosshair 26 are shown extending from ring 22 with the lower part of the vertical crosshair shown as part of the enlarged portion. In this view it will be seen that the pointer of pendulum member 28 shown in solid line is in alignment with the vertical crosshair 24, which indicates that the rifle is not tilted or canted, but is positioned with the barrel 20 of the sight 10 directly above the bore of the rifle 12. Should the rifle 12 be canted or tilted in either direction, the pointer of pendulum member 28 will continue to point in an upward direction, but this will be out of alignment with the vertical crosshair 24, as shown in phantom and this will then be apparent to the shooter.

FIG. 5 is a graph wherein, assuming 1 degree of camber or cant of the rifle, the number of inches off target is plotted against the range in yards to the target. As indicated, the error would be only slightly over one inch at 200 yards, but over five inches at 1000 yards. With larger amounts of cant, the corresponding graphs would be proportionately steeper, indicating greater distances off target for the impact.

The above described embodiment of the present invention is merely descriptive of its principles and is not to be considered limiting. The scope of the present invention instead shall be determined from the scope of the following claims including their equivalents.

What is claimed is:

1. For use with a firearm, a telescopic sight including a barrel, lenses in said barrel, and vertical and horizontal crosshairs visible in said barrel;

characterized in that gravity responsive means including gravity indicating means is located entirely within said barrel;

said gravity responsive means comprising a ring having an annular face affixed in said barrel, and a pendulum member including a pointer pivotally fastened to said annular face of said ring, said pendulum member having its rotational axis intersecting said vertical crosshair; and such that alignment of said vertical crosshair and said pointer is indicative that said firearm is not tilted.

2. A telescopic sight as claimed in claim 1 wherein said pendulum member is attached to said ring by means of a screw and said screw is adjustable to vary the response of said gravity responsive means.

3. A telescopic sight for use with a rifle having a bore, said sight including a barrel, lenses in said barrel, and a reticle in said barrel include a vertical crosshair;

characterized in that a ring having an annual face is affixed in said barrel, said vertical crosshair is carried on said ring, and a pendulum member including a vertical indicating pointer is attached to said annular face of said ring such that the rotational axis of said pendulum member intersects said vertical crosshair, whereby canting of said rifle is indicated by a misalignment of said pointer relative to said vertical crosshair.

4. A telescopic sight as claimed in claim 3 wherein said pendulum member includes a weight normally positioned below its rotational axis such that when said firearm is not canted, said pointer it aligned with said vertical crosshair.

* * * * *